US006864446B1

(12) United States Patent
Mills

(10) Patent No.: US 6,864,446 B1
(45) Date of Patent: Mar. 8, 2005

(54) INTERNAL ROLLING SEAL DESIGN FOR CIRCUIT BREAKERS

(75) Inventor: Patrick W. Mills, Bradenton, FL (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/814,622

(22) Filed: Mar. 31, 2004

(51) Int. Cl.[7] ..... H01H 13/06
(52) U.S. Cl. ..... 200/302.2
(58) Field of Search ..... 200/302.1–302.3, 200/341–345, 308–316

(56) References Cited

U.S. PATENT DOCUMENTS 3,876,851 A * 4/1975 McMains et al. ..... 200/302.2
4,918,270 A * 4/1990 Orrico ..... 200/302.2
5,199,557 A * 4/1993 Brandt et al. ..... 200/345 X
5,306,886 A * 4/1994 Yamada ..... 200/345 X
5,430,267 A * 7/1995 Ozeki et al. ..... 200/302.2
5,459,446 A 10/1995 Vidal et al.
6,225,883 B1 5/2001 Wellner et al.
6,307,453 B1 10/2001 Wellner et al.
6,522,228 B2 2/2003 Wellner et al.
6,542,056 B2 4/2003 Nerstrom et al.

* cited by examiner

*Primary Examiner*—James R. Scott
(74) *Attorney, Agent, or Firm*—Marvin L. Union

(57) ABSTRACT

The present invention provides a rolling seal that is disposed between the handle and the housing. The subminiature circuit breaker has a housing and a handle assembly as noted above. The housing has a handle opening bushing that includes at least one through opening. The handle assembly has a handle member disposed in the handle opening which is structured to move between a first position and a second position. The handle member further has an attachment ring. The rolling seal includes a flexible tubular member having a first end and a second end, and a lip. Said lip extends inwardly toward the axis of the tubular member. The lip is disposed at the first end of the tubular member and the second end is disposed at the second end of the tubular member. The lip is structured to engage the handle opening at least one through opening and the second end is structured to engage the attachment ring.

16 Claims, 3 Drawing Sheets

INTERNAL ROLLING SEAL DESIGN FOR CIRCUIT BREAKERS

BACKGROUND OF THE INVENTION

1. Field of the Invention

The present invention relates to subminiature circuit breakers and, more specifically, to a seal for the handle on a subminiature circuit breaker.

2. Background Information

One use of subminiature circuit breakers is in aircraft electrical systems where they not only provide overcurrent protection but also serve as switches for turning equipment on and off. As such, they are subjected to heavy use and therefore must be capable of performing reliably over many operating cycles. Subminiature circuit breakers may further be used in an environment where they are subject to vibration. The subminiature circuit breakers include a pair of seperable contacts and an operating mechanism disposed within a housing. A handle extends through the housing and may be used to turn the subminiature circuit breaker on or off, or reset the subminiature circuit breaker after it has tripped.

The housing cavity of a subminiature circuit breaker must be kept free from contamination and must not allow exhaust gases to escape through the handle opening. Presently subminiature circuit breakers utilize a handle that has an interference fit with the housing. Such an interference fit is not always airtight and is subject to wear and tear due to use or vibration. That is, as the handle is moved in and out, the housing, the handle, or a seal such as an O-ring may become worn and allow particles and/or gas to pass therethrough.

There is, therefore, a need for a seal disposed between the handle member and the housing of a subminiature circuit breaker.

There is a further need for such a seal to resist wear and tear.

SUMMARY OF THE INVENTION

These needs, and others, are met by the present invention which provides a rolling seal that is disposed between the handle and the housing. The subminiature circuit breaker has a housing and a handle assembly as noted above. The housing has a handle opening bushing that includes at least one through opening. The handle assembly has a handle member disposed in the handle opening which is structured to move between a first position and a second position. The handle member further has an attachment ring. The rolling seal includes a flexible tubular member having a first end and a second end, and a lip. The lip extends inwardly toward the axis of the tubular member. The lip is disposed at the first end of the tubular member. The lip is structured to engage the handle at least one through opening and the second end is structured to engage the attachment ring.

To install the rolling seal, the first end is folded, or rolled, outwardly into a cuff so that the lip may engage the at least one through opening while the second end may engage the attachment ring. The lip may be bonded to the at least one through opening and the second end may be bonded to the attachment ring. In this configuration, the seal extends between the handle member and the housing. As the handle member moves between the first and second positions, the length of the cuff on the rolling seal increases and decreases as the tubular member second end moves along with the attachment ring. This type of seal resists wear as the seal does not rub against other parts. Additionally, the tubular member may be made from a material that has a color that is a high contrast color relative to said circuit breaker housing. Thus, as the seal moves in and out of the handle opening bushing, the high contrast color on the seal is noticeable to the user and provides an indication as to the status, i.e, open or closed, of the circuit breaker.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
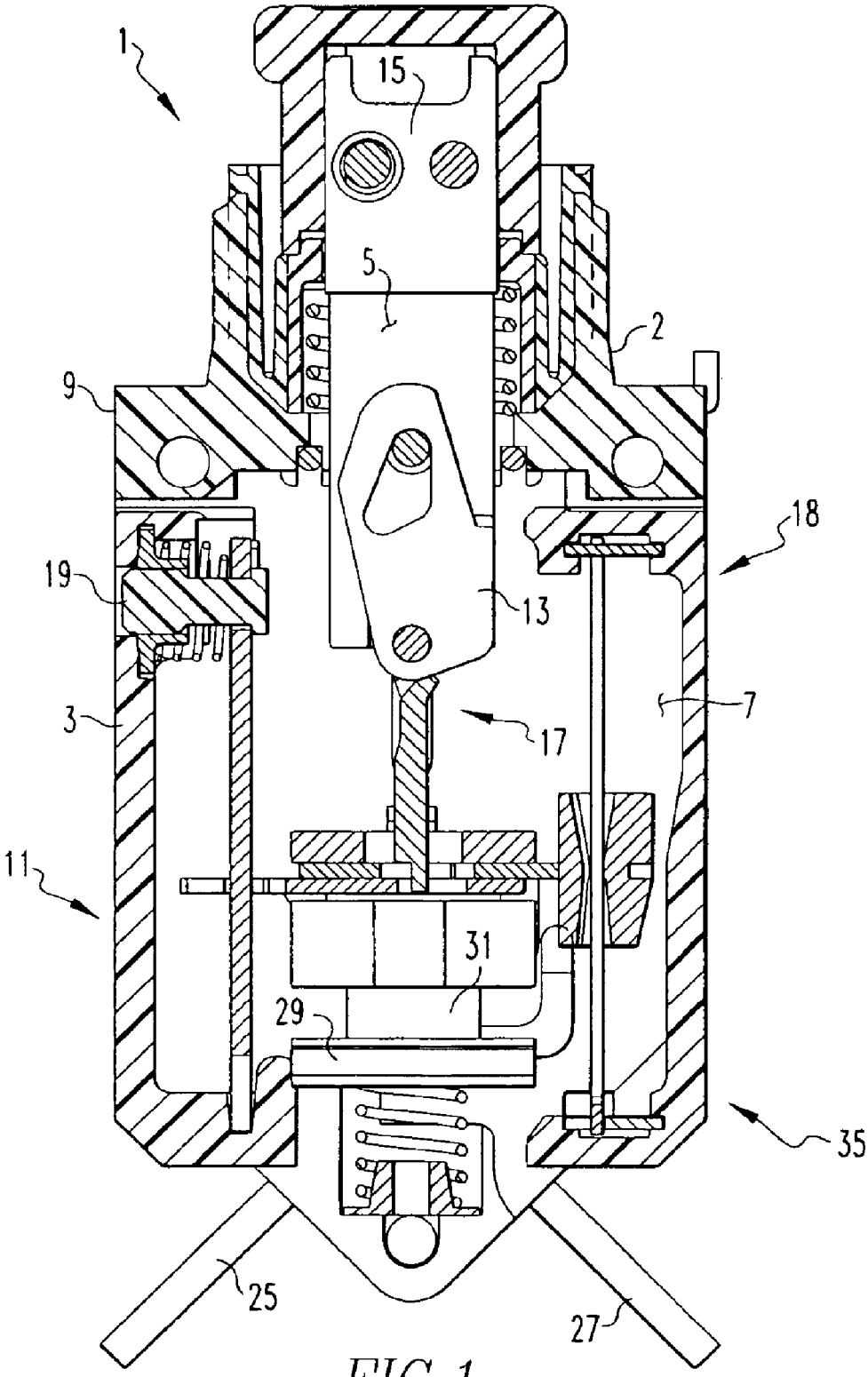
FIG. 1 is a cross-sectional view of a circuit breaker showing the circuit breaker in the "on" condition.

Referring to FIG. 1, the subminiature circuit breaker 1 has a housing 3 molded of an insulative resin which defines a cavity 7. The housing 3 of the circuit breaker 1 may have a metallic top wall 9 although alternatively this top wall can be part of the molded housing 3. The top wall 9 includes a handle opening bushing 2 that defines and opening 5. The functional components of the circuit breaker 1 include a separable contact assembly 1, a toggle mechanism 13, a handle assembly 15, a latch assembly 17, and an overcurrent assembly 19. The toggle mechanism 13 and latch assembly 17 together form a latchable operating mechanism 18. The circuit breaker 1 also includes a line terminal 25 and load terminal 27 supported in the bottom of the molded housing 3 and having cantilevered sections extending outside of the housing 3 for connection to the line and load conductors, respectively (not shown). The separable contact assembly 11 includes a fixed contact 29 fixed to the line terminal 25 and a moveable contact 31 carried by a contact arm. The fixed contact 29 and moveable contact 31 together form separable contacts 35. The separable contacts 35 are structured to move between a first, open position and a second, closed position as is known in the art. The separable contacts 35 are moved between the first, open and second, closed positions by the operating mechanism 18.

Figure 2:
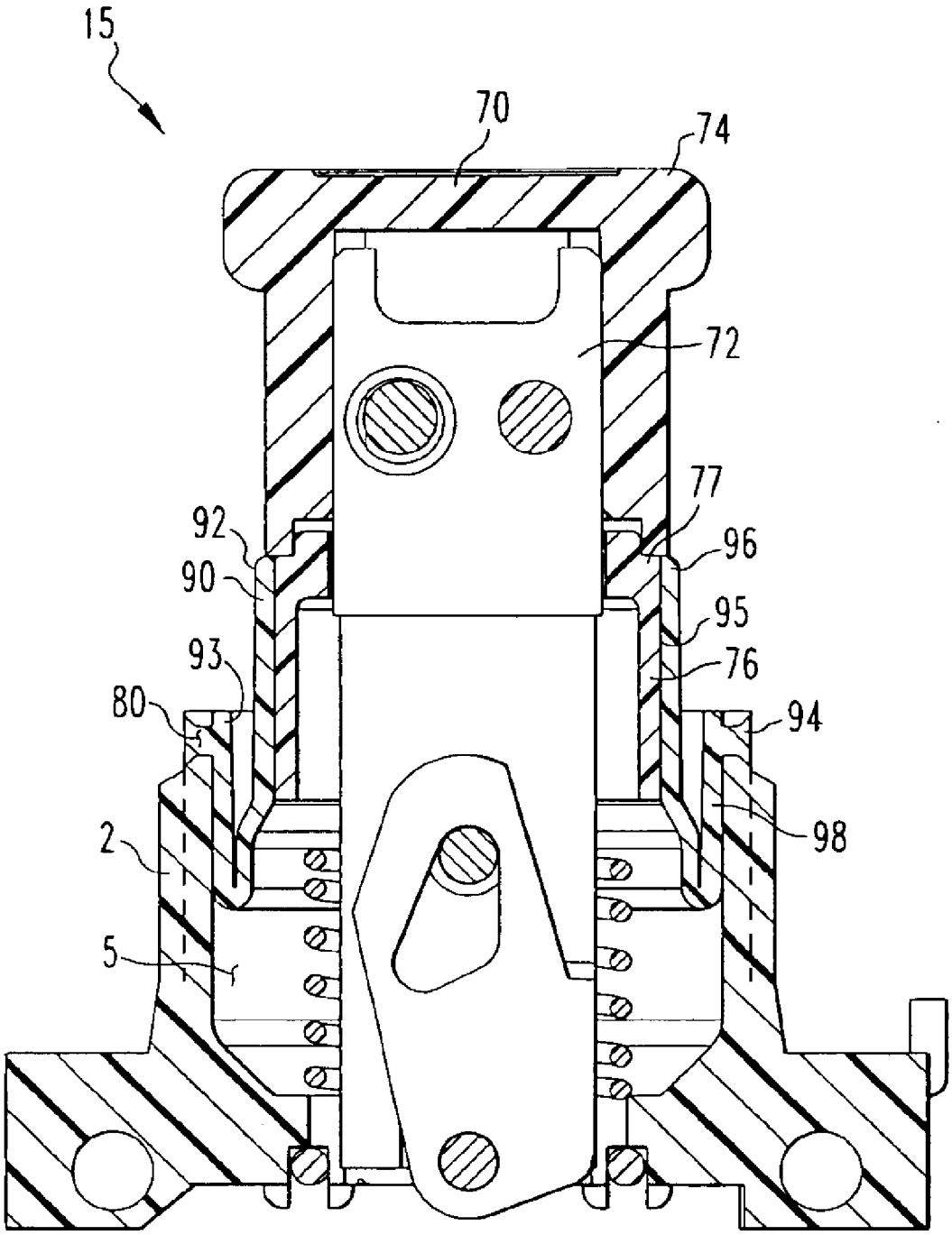
FIG. 2 is a detailed cross-sectional view of the circuit breaker illustrating the handle assembly in the "off" condition.
Figure 3:
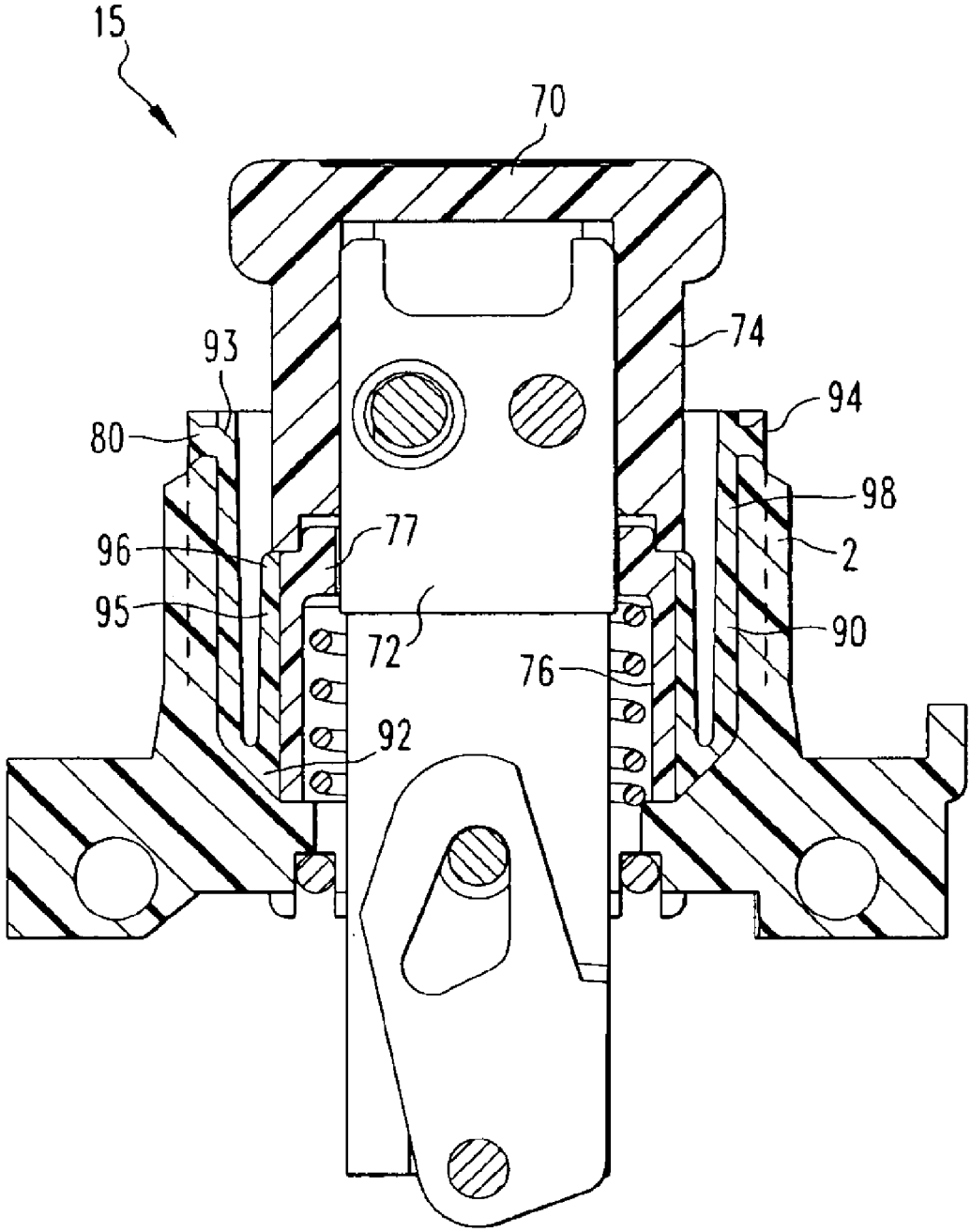
FIG. 3 is a detailed cross-sectional view of the circuit breaker illustrating the handle assembly in the "on" condition.

As can be seen from FIG. 2, the handle assembly 15 includes a handle member 70 having an inner stem 72, which is pivotally connected to the operating mechanism 18, as well as an outer button 74 and a collar 76. The collar 76 includes an attachment ring 77. The attachment ring 77 is structured to be engaged by the rolling seal tubular member second end 95 (described below). The handle member 70 is structured to move between a first (FIG. 2) and second position (FIG. 3) corresponding to the first, open position and a second, closed position of the separable contact assembly 11.

The handle member 70 is supported for reciprocal linear movement by the handle opening bushing 2 and passes through the opening 5. The handle opening bushing 2 includes at least one through opening 80 molded into the bushing. The handle at least one through opening 80 is, preferably, disposed at the top of the handle opening bushing 2. The handle at least one through opening 80 is structured to be engaged by the at least one rolling seal tubular member stud 94 (described below).

A rolling seal 90 is disposed between the handle member 70 and the handle opening bushing 2. The rolling seal 90 includes a flexible tubular member 92 having a first end 93 and a second end 95. At least one stud 94 is disposed at the first end 93. The at least one stud 94 extends inwardly toward the axis of the tubular member 92. The at least one stud 94 is structured to engage the handle at least one through opening 80. The second end 95 is structured to engage said attachment ring 77. Preferably, the at least one stud 94 is bonded to the at least one through opening 80. In a preferred embodiment, the tubular member 92 is made from silicon and has a circular cross-sectional shape. In this embodiment, the handle opening bushing 2 also has a circular cross-sectional shape. Preferably, the tubular member 92 has a thickness of between about 0.01 and 0.019 in., and more preferably about 0.018 in.

To be installed, the tubular member first end 93 is folded, or rolled, outwardly to form a cuff 98 and so that the at least one stud 94 faces outwardly. The handle member 70, which is not coupled to the operating mechanism 18., is then inserted into the tubular member second end 95 until the second end 95 is adjacent to the attachment ring 77. The second end 95 is bonded to the attachment ring 77. The handle member 70 is inserted through the handle opening bushing 2 and coupled to the operating mechanism 18. The at least one stud 94 then engages the handle at least one through opening 80 and may be bonded thereto. Thus, the opening 5 is sealed by the tubular member 92. In operation, as the handle member 70 moves between the first and second positions, the length of the cuff 98 on the rolling seal increases and decreases as the tubular member second end 95 moves along with the attachment ring 77.

Additionally, the seal may be used to indicate the position of the circuit breaker 1. That is, the rolling seal 90 may be colored differently from the circuit breaker housing 3 or the top wall 9 and/or the handle member 70. Preferably, the tubular member 92 is a color that is a high contrast color relative to said circuit breaker housing 3 or the top wall 9 and/or the handle member 70. For example, if the housing 3 or the top wall 9 and/or the handle member 70 are a dark color, the tubular member 92 should be a light color. Because the tubular member 92 is exposed when the handle member 70 is in the first position and the tubular member 92 is substantially hidden when the handle member 70 is in the second position, the user may determine the status of the circuit breaker 1, i.e. open or closed, by observing if the tubular member 92 is visible or not.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A rolling seal for a subminiature circuit breaker, said subminiature circuit breaker having a housing and a handle assembly, said housing having a handle opening bushing that includes at least one through opening, said handle assembly having a handle member disposed in said handle opening and structured to move between a first position and a second position, said handle member further having an attachment ring, said rolling seal comprising:

a flexible tubular member having a first end and a second end, a lip, the lip extending inwardly, said lip disposed at said first end;

said lip structured to engage said handle at least one through opening;

said second end structured to engage said attachment ring; and wherein said first end is folded outwardly into a cuff so that said lip may engage said bushing at least one through opening while said second end may engage said attachment ring.

2. The rolling seal of claim 1 wherein:

said lip structured to be bonded to said at least one through opening; and said second end structured to be bonded to said attachment ring.

3. The rolling seal of claim 1 wherein said tubular member has a circular cross-sectional shape.

4. The rolling seal of claim 1 wherein said tubular member is made from silicon.

5. The rolling seal of claim 1 wherein said tubular member has a thickness of between about 0.01 and 0.019 inch.

6. The rolling seal of claim 5 wherein said tubular member has a thickness of about 0.18 inch.

7. The rolling seal of claim 1 wherein said tubular member has a color that is a high contrast color relative to said circuit breaker housing.

8. The rolling seal of claim 1 wherein said tubular member has a color that is a high contrast color relative to said handle member.

9. A subminiature circuit breaker comprising:

a housing, said housing having a handle opening bushing that includes at least one through opening;

a separable contact assembly, having a fixed contact and a movable contact, structured to move between a first, open position and a second, closed position;

an operating mechanism coupled to said separable contact assembly and structured to move said separable contact assembly between said first, open position and said second, closed position;

a handle assembly, said handle assembly structured to move between a first and second position and further coupled to said operating mechanism, said first and second position of said handle assembly corresponding to said separable contact assembly first, open position and second, closed position;

said handle assembly having a handle member with an attachment ring;

said handle member disposed in said handle opening;

a rolling seal comprising:

a flexible tubular member having a first end and a second end, a lip, the lip extending inwardly, said lip disposed at said first end;

said lip structured to engage said handle at least one through opening;

said second end structured to engage said attachment; and wherein said first end is folded outwardly into a cuff so that said lip may engage said at least one through opening while said second end may engage said attachment ring.

10. The subminiature circuit breaker of claim 9 wherein:

said lip structured to be bonded to said at least one through opening; and said second end structured to be bonded to said attachment ring.

11. The subminiature circuit breaker of claim 9 wherein said tubular member has a circular cross-sectional shape.

12. The subminiature circuit breaker of claim 9 wherein said tubular member is made from silicon.

13. The subminiature circuit breaker of claim 9 wherein said tubular member has a thickness of between about 0.01 and 0.019 inch.

14. The subminiature circuit breaker of claim 13 wherein said tubular member has a thickness of about 0.18 inch.

15. The subminiature circuit breaker of claim 9 wherein said tubular member has a color that is a high contrast color relative to said circuit breaker housing.

16. The subminiature circuit breaker of claim 9 wherein said tubular member has a color that is a high contrast color relative to said handle member.

* * * * *